US008490597B2

(12) United States Patent
Kurihara

(10) Patent No.: US 8,490,597 B2
(45) **Date of Patent: *Jul. 23, 2013**

(54) VERTICAL AND HORIZONTAL ENGINE

(75) Inventor: Katsumi Kurihara, Aichi (JP)

(73) Assignee: ETG Limited, Central (HK)

( * ) Notice: Subject to any disclaimer, the term of this patent is extended or adjusted under 35 U.S.C. 154(b) by 3 days.

This patent is subject to a terminal disclaimer.

(21) Appl. No.: 13/286,323

(22) Filed: Nov. 1, 2011

(65) Prior Publication Data

US 2012/0132171 A1 May 31, 2012

Related U.S. Application Data

(63) Continuation-in-part of application No. 12/954,945, filed on Nov. 29, 2010.

(51) Int. Cl.
*F02B 77/00* (2006.01)

(52) U.S. Cl.
USPC ..... 123/195 C; 123/196 R; 123/196 CP; 184/6.28

(58) Field of Classification Search
USPC ..... 123/195 C, 196 R, 196 CP; 184/11.1, 184/11.2, 13.1, 6.28, 6.8, 6.9
See application file for complete search history.

(56) References Cited

U.S. PATENT DOCUMENTS

| | | | | |
|---|---|---|---|---|
| 6,213,079 | B1 * | 4/2001 | Watanabe | 123/196 R |
| 6,250,273 | B1 | 6/2001 | Ryu et al. | |
| 7,134,418 | B2 * | 11/2006 | Nagel et al. | 123/196 R |
| 7,287,508 | B2 | 10/2007 | Kurihara | |
| 7,624,714 | B2 | 12/2009 | Kurihara et al. | |

* cited by examiner

*Primary Examiner* — Noah Kamen
*Assistant Examiner* — Hung Q Nguyen
(74) *Attorney, Agent, or Firm* — IPUSA, PLLC

(57) ABSTRACT

An engine lubrication and speed control method is provided. The four-cycle engine has a lightweight aluminum alloy engine block having a cylindrical bore and an oil reservoir formed therein. A vertical or horizontal crankshaft is rotatably mounted in the engine block for rotation about a crankshaft axis. A piston reciprocates within the bore and is connected to the crankshaft by a connecting rod. An oil pump is driven by the camshaft connected with a cam gear, which mates with a crank gear that is driven by the crankshaft, inhales the oil from the oil reservoir to splash lubricate into the cylinder bore and valve chamber. The engine is provided with a cylinder head assembly defining a compact combustion chamber having a pair of overhead intake and exhaust ports and cooperating intake and exhaust valves. A commonality of parts between the horizontal and the vertical engine is highly achieved.

10 Claims, 13 Drawing Sheets

VERTICAL AND HORIZONTAL ENGINE

CROSS REFERENCE TO RELATED APPLICATIONS

This is a continuation-in-part application of U.S. application Ser. No. 12/954,945 filed on Nov. 29, 2010, the entire contents of which are incorporated herein by reference.

BACKGROUND OF THE INVENTION

1. Field of the Invention

This invention relates to an engine, and more particularly, a small four-cycle utility engine which is particularly suitable for typical power tools driven by a vertical or horizontal power shaft.

2. Description of the Related Art

U.S. Pat. No. 7,287,508 to Kurihara and U.S. Pat. No. 7,624,714 to Kurihara et al. disclose a prior art small four-cycle engine construction for portable power tools.

Portable power tools such as line trimmers, blowers/vacuums, and chain saws must be able to run in a very wide range of orientations. However, in most power tools such as generators or tillers/cultivators, power shaft orientation is either substantially horizontal or vertical. Therefore, it is not necessary for these typical power tools to be able to run in a very wide range of orientations having complicated and economically ineffective constructions as in the above-referenced inventions.

For some tillers/cultivators powered by four-cycle engines with a vertical power shaft, lubrication also becomes a serious problem since it is difficult to use the same lubrication system as engines with a horizontal power shaft.

U.S. Pat. No. 6,250,273 to Ryuu et al. discloses a utility engine for horizontal and vertical shaft orientations. However, constructions are still complicated because special rotating parts having shafts other than a crankshaft or a camshaft are necessary for lubrication and speed control.

Therefore, it is an object of the present invention to provide a small four-cycle utility engine having an internal lubrication system, which is especially suitable for both vertical and horizontal power shaft engines.

It is a further object of the present invention to provide a small four-cycle utility engine having a speed control system enabling the engine to be run at a desired speed at any load, which is especially suitable for both vertical and horizontal power shaft engines.

It is yet a further object of the invention to provide a breathing system to work effectively throughout the normal range of operating positions, which is especially suitable for both vertical and horizontal power shaft engines.

It is yet a further object of the invention to provide a commonality of main parts between vertical and horizontal engines, which is especially suitable for both vertical and horizontal power shaft engines to reduce manufacturing cost.

These and other objects, features, and advantages of the present invention will become apparent upon further review of the remainder of the specification and the accompanying drawings.

SUMMARY OF THE INVENTION

In order to achieve the above objects, a four-cycle, utility engine is provided which is suitable for both vertical and horizontal power shaft engine.

The four-cycle, vertical shaft utility engine is provided with an engine block having at least one cylindrical bore oriented in a substantially horizontal orientation having an enclosed crankshaft chamber. A vertical crankshaft is pivotably mounted within the engine block. An enclosed oil reservoir is formed with the engine block and side cover and is located below the crankshaft chamber. The enclosed oil reservoir when properly filled, enables the engine to rotate at least 30 degrees about the crankshaft axis in either direction without oil within the reservoir rising above the level of the crankshaft counter weight. A pump is connected drivably to said cam gear-cam assembly, said pump inhales lubrication oil from the oil reservoir through an inhale passage on a wall of the side cover to splash oil into the cylinder and valve train. Said inhale passage of the oil pump is extended to near another wall of said side cover, which is located below the cylindrical bore when the power shaft of said engine is oriented to be horizontal.

A sister engine, which is a horizontal shaft utility engine, is provided. Main parts of both vertical and horizontal engine are substantially common. The sister engine has an engine block having at least one cylindrical bore oriented in a substantially vertical orientation having an enclosed crankshaft chamber. A horizontal crankshaft is pivotably mounted within the engine block. An enclosed oil reservoir formed with the engine block and side cover and is located below the crankshaft chamber. The enclosed oil reservoir when properly filled, enables the engine to rotate at least 30 degrees about the crankshaft axis in either direction without oil within the reservoir rising above the level of the crankshaft counter weight. A pump is connected drivably to said cam gear-cam assembly, said pump inhales lubrication oil from the oil reservoir through an inhale passage on a wall of the side cover to splash oil into the cylinder and valve train.

In both the vertical and horizontal engine, a de-compressor system is provided on the cam gear to make starting of the engine easy. A speed control system is also provided on the cam gear at a reverse side of the de-compressor.

In both the vertical and horizontal engine, a breathing system is provided at a location in which an oil level within the reservoir is not above the breathing system.

DESCRIPTION OF THE EMBODIMENTS

Figure 1:
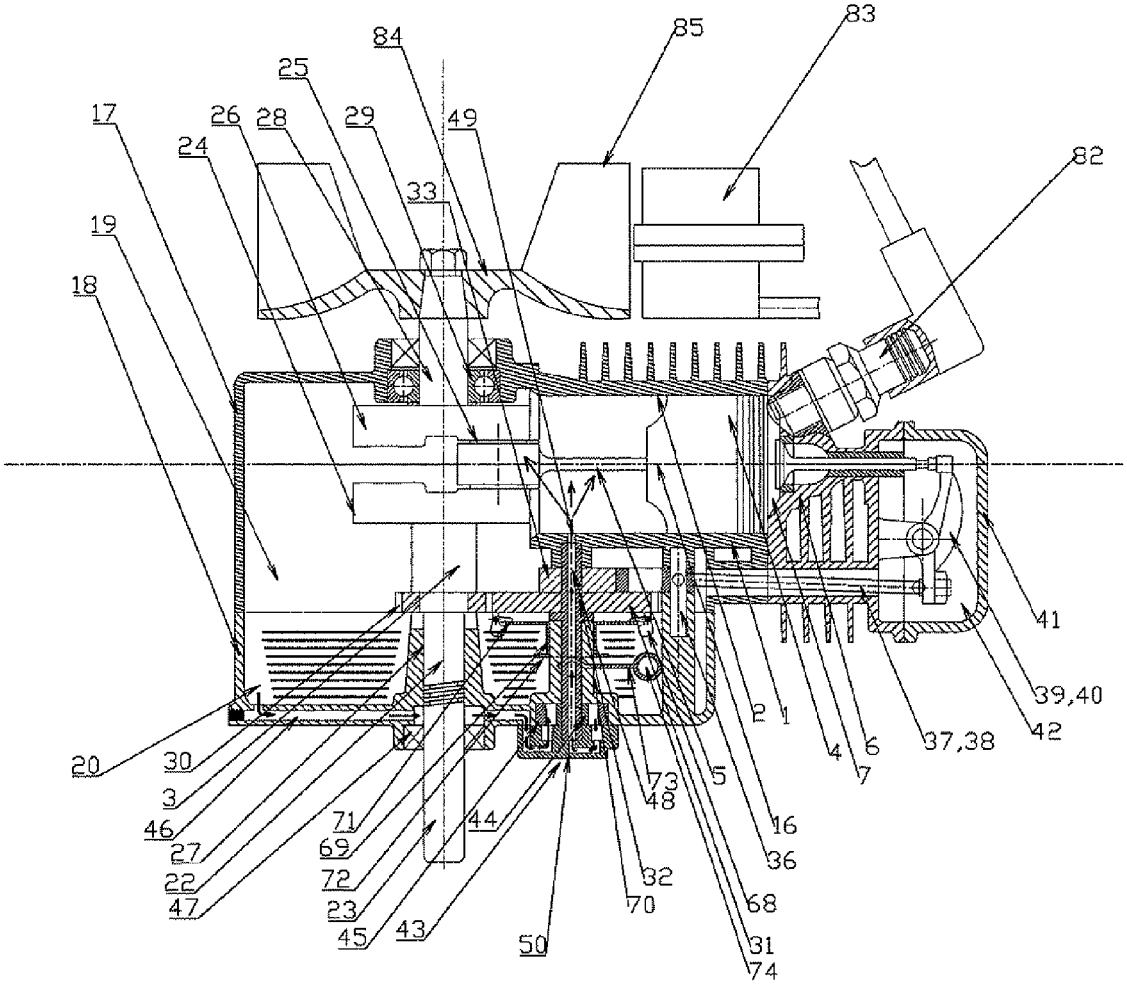
FIG. 1 is a cross-sectional side elevation view of the vertical shaft engine taken along the rotating axis of the crankshaft and axis of a cylinder bore.

FIG. 1 illustrates a cross-sectional side elevation view of a vertical shaft four-cycle engine. The four-cycle engine is made up of a lightweight aluminum housing including a cylinder block 1 having a cylindrical bore 2 formed therein.

Figure 5:
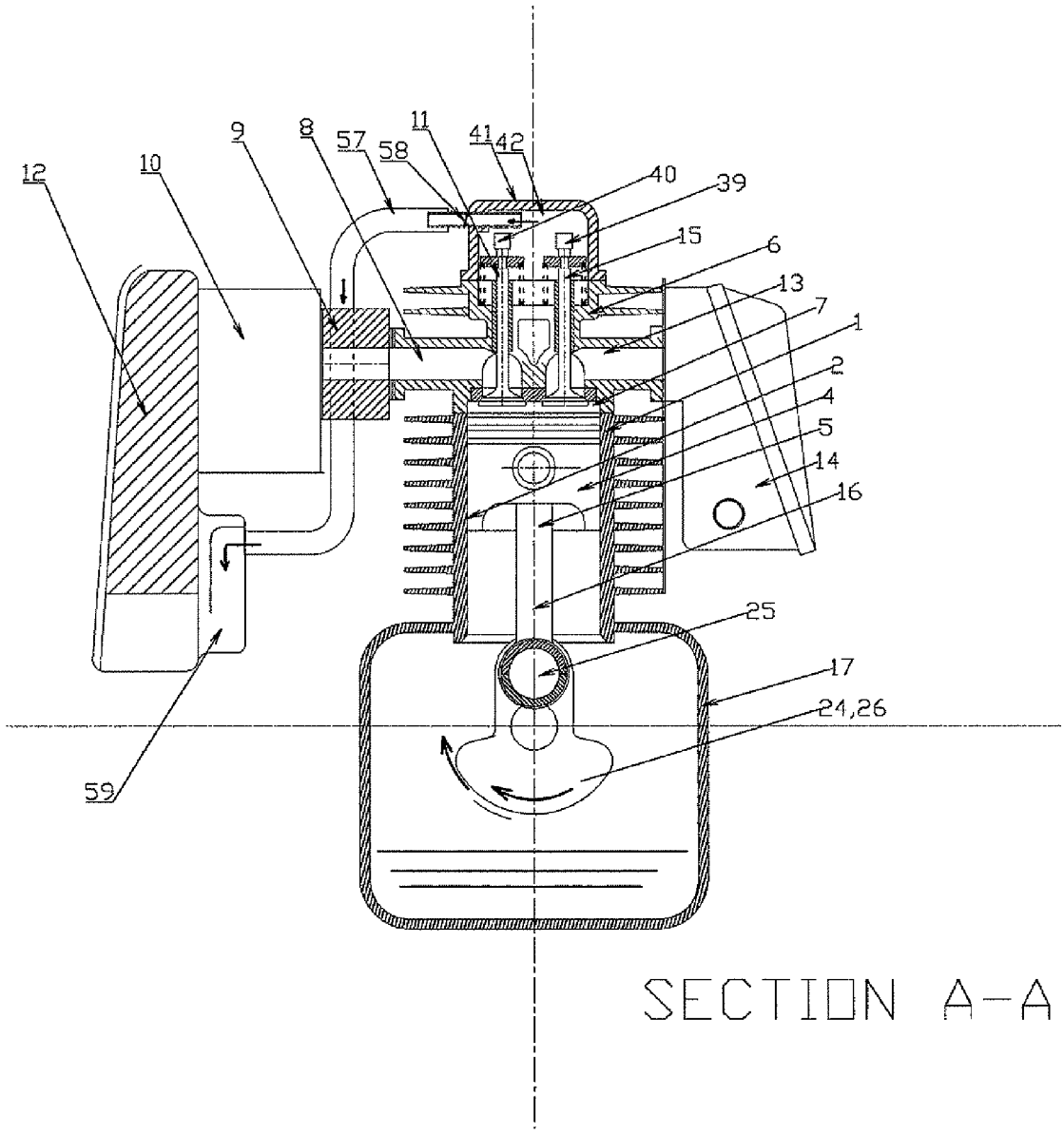
FIG. 5 is a cross-sectional side elevation view of the engine taken along line A-A in FIG. 2 to show detailed construction of a breather system.

A crankshaft 3 is a power shaft and is pivotably mounted within the engine block 1 in a conventional manner. A piston 4 slides within the cylinder bore 2 and is connected to the crankshaft 3 by a connecting rod 5. A cylinder head 6 is affixed to the engine block 1 to define an enclosed combustion chamber 7. In FIG. 5, the cylinder head 6 is provided with an intake port 8 coupled to an insulator 9 and carburetor 10 and selectively connected to the combustion chamber 7 via an intake valve 11. A filter element 12 of an air cleaner is provided to eliminate dust from the intake air into the engine. The cylinder head 6 is also provided with an exhaust port 13 connected to a muffler 14 and selectively connected to the combustion chamber 7 by an exhaust valve 15.

Figure 2:
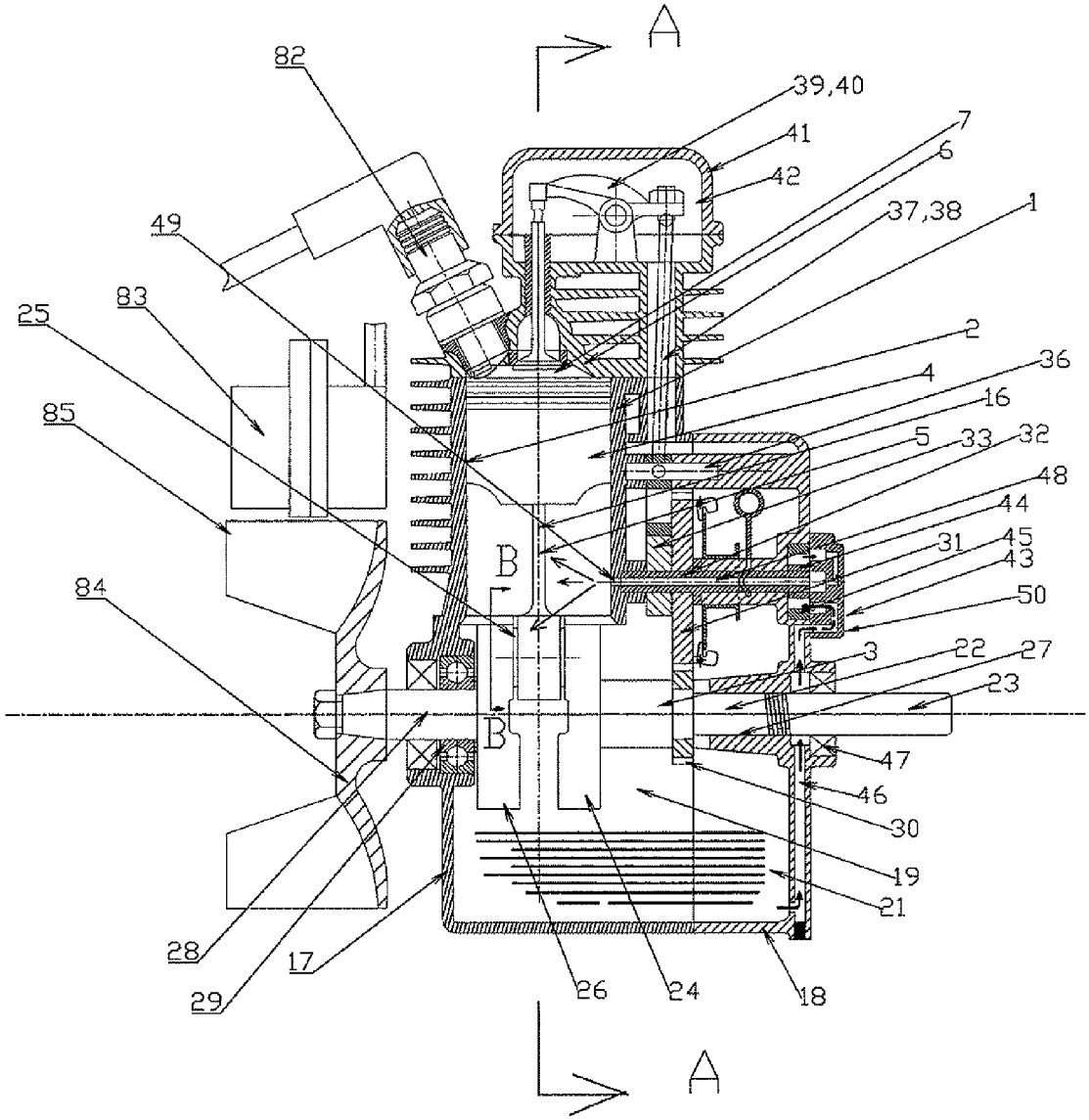
FIG. 2 is a cross-sectional side elevation view of the horizontal shaft engine taken along the rotating axis of the crankshaft and axis of the cylinder bore.

As illustrated in FIGS. 1 and 2, the cylinder axis 16 of a four-cycle engine is generally upright when in a horizontal power shaft engine and is generally horizontal when in a vertical power shaft engine.

The cylinder block 1 is integrally connected to a crankcase 17. A side cover 18 mates with the crankcase 17 at the interface which is perpendicular to the crankshaft axis and forms a crankshaft chamber 19 with the crankcase 17.

The crankcase 17 and the side cover 18 also provide an enclosed oil reservoir 20 in a vertical shaft engine as illustrated in FIG. 1 and an oil reservoir 21 in a horizontal engine as illustrated in FIG. 2.

The oil reservoir 20 or 21 is relatively deep so that there is ample clearance between the crankshaft 3 and the level of the oil within the oil reservoir during normal use (vertical or horizontal orientation of the crankshaft).

The crankshaft 3 is provided with an axial shaft 22 coupled to an output end 23 adapted to be coupled to a counterweight web 24. A crankpin 25 is affixed to counterweight web 24 and is parallel to and radially offset from the axial shaft 22. The crankpin 25 pivotally cooperates with connecting rod 5. The axial shaft 22 of crankshaft 3 is pivotably attached to the side cover 18 by a bearing 27. Another axial shaft 28 of the crankshaft 3 is coupled to a counterweight web 26 and is pivotably attached to the cylinder block 1 by a bearing 29.

At the side of bearing 27 is a crank gear 30.

Figure 7:
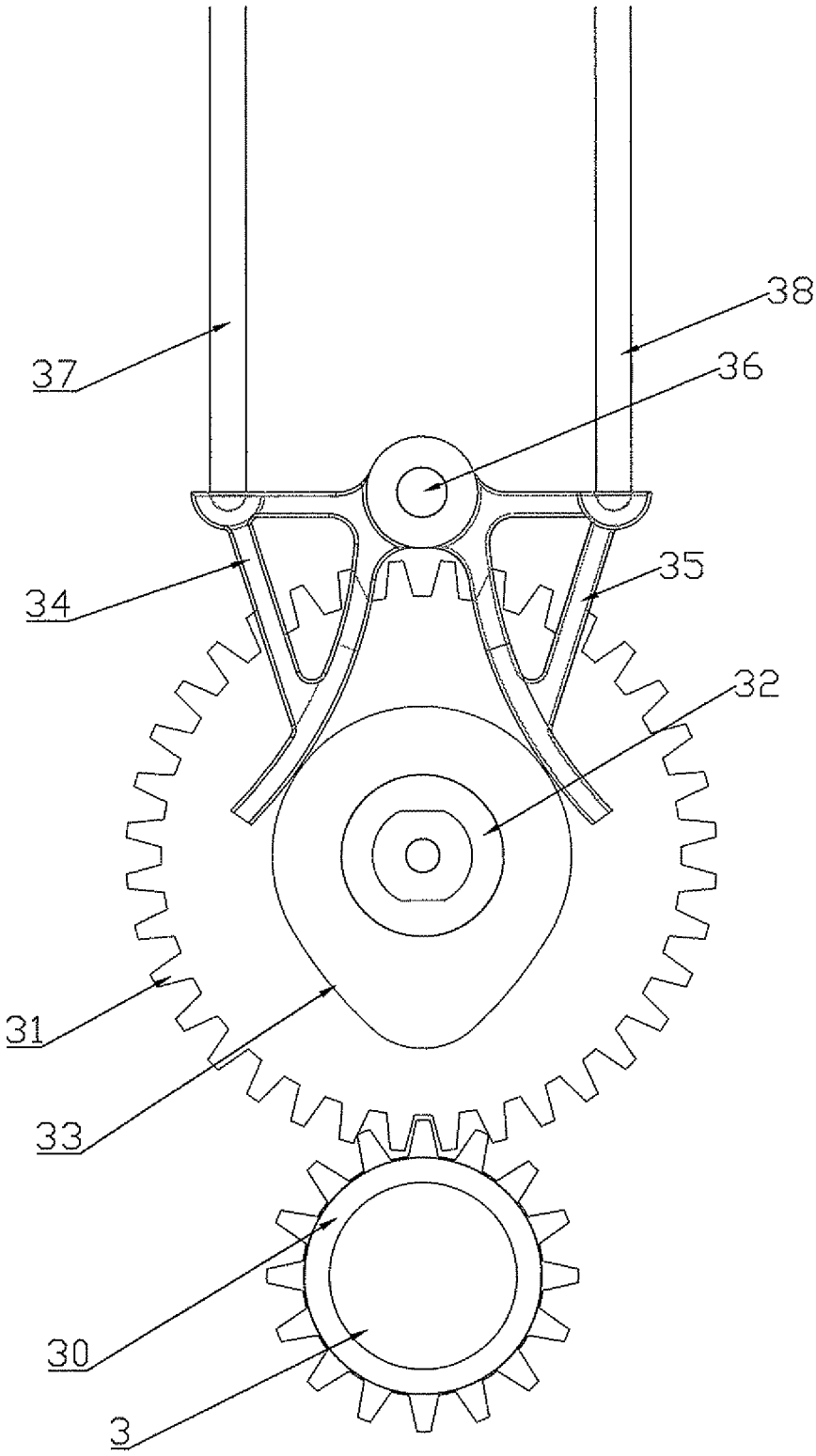
FIG. 7 is an enlarged schematic illustration of the camshaft and the follower mechanism.

A camshaft drive and valve lifter mechanism is best illustrated in FIGS. 1 and 7. The crank gear 30 is mounted on the crankshaft 3, which in turn drives a cam gear 31 with twice the number of teeth as the crank gear 30 resulting in the camshaft 32 rotating at one-half engine speed. The cam gear 31 is affixed to the camshaft 32 which is journaled to the cylinder block 1 and includes a rotary cam lobe 33.

In the embodiment illustrated, a single cam lobe 33 is utilized for driving both the intake and exhaust valves 11, 15.

Followers 34 and 35 are pivotably connected to the cylinder block 1 by a pivot pin 36.

Push rods 37 and 38 extend between camshaft followers 34 and 35 and rocker arms 39 and 40 located within the cylinder head 6. The cam lobe 33, push rods 37, 38 and rocker arms 39, 40 are part of a valve train assembly. Affixed to the cylinder head 6 is a valve cover 41 which defines therebetween an enclosed valve chamber 42.

As illustrated in FIGS. 1 and 2, in order to lubricate the engine, a trochoid pump 43 is placed at a wall of the side cover 18. The pump 43 has an inner rotor 44 and outer rotor 45. In other embodiments of the present application, a gear pump may be used.

The camshaft 32 is extended to the wall of the side cover 18 and drives the inner rotor 44 and the outer rotor 45 is rotated following the rotation of the inner rotor 44. Lubrication oil is inhaled from a passage 46, which is extended to another wall of side cover 18 thorough a space between bearing 27 and an oil seal 47.

An end of the passage 46 leads to the oil entrance of the pump. The other end of passage 46 is connected to an oil entrance at oil reservoir 20 or 21.

In the vertical shaft engine as illustrated in FIG. 1, the entrance of the oil passage 46 is dipped in the oil in the oil reservoir 20 within a certain inclination range of the power shaft from the normal position, because the oil passage 46 is substantially horizontal at the normal position.

In the horizontal shaft engine as illustrated in FIG. 2, although oil passage 46 is substantially vertical at the normal position, the entrance of the oil passage 46 is dipped in the oil in the oil reservoir 21 within a certain inclination range of the power shaft from the normal position.

The pump 43 and the side cover 18 can be commonly used between the vertical shaft engine as in FIG. 1 and the horizontal shaft engine as in FIG. 2.

The oil pushed out by the pump 43 is lead to the cylinder bore 2 through an inner through hole 48 of the camshaft 32 and a hole 49 at the cylinder wall as illustrated in FIG. 1 and FIG. 2.

Figure 9:
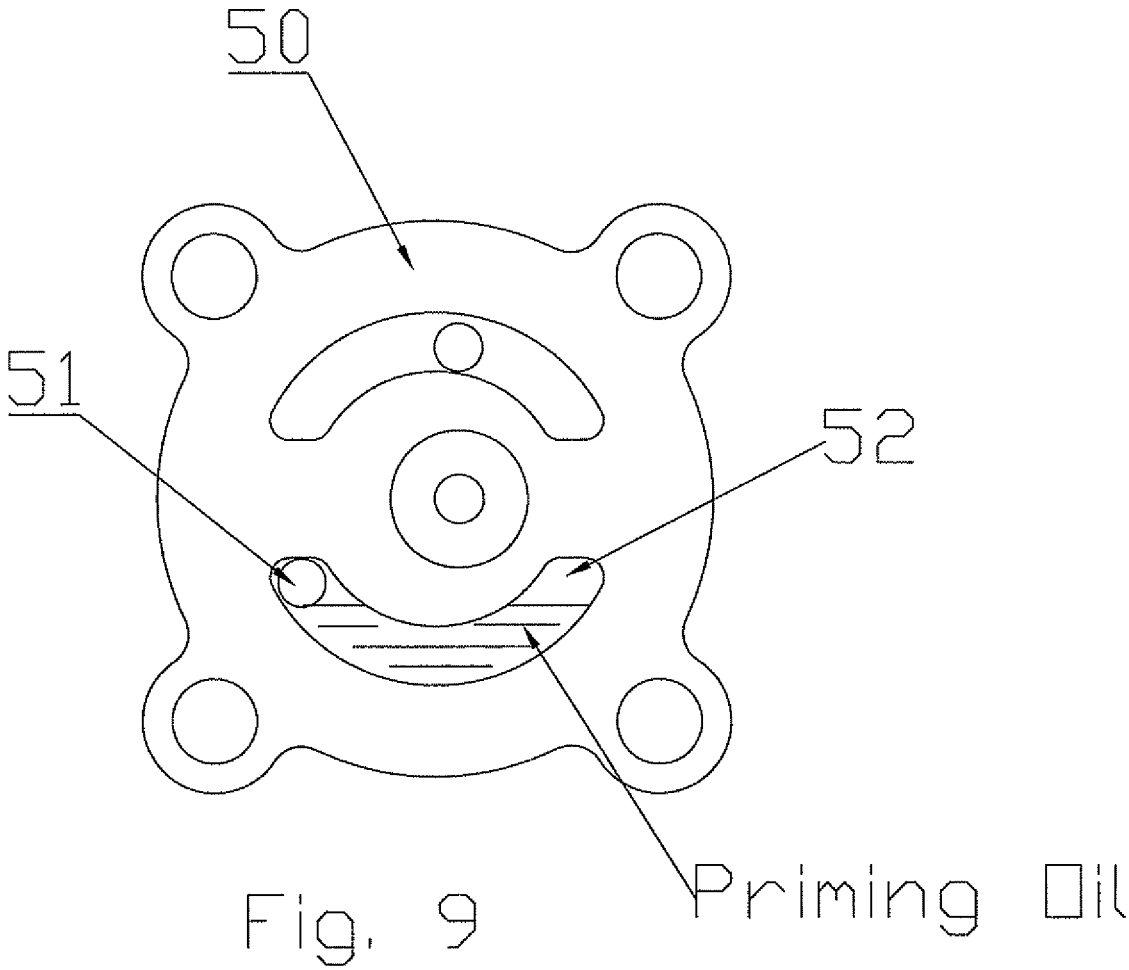
FIG. 9 is a sectional view of the oil pump cover that shows keeping of priming oil for an inlet cavity of the pump.

As illustrated in FIG. 9, in the horizontal shaft engine of FIG. 2, an oil entrance hole 51 in the pump cover 50 is located at the highest position of inlet cavity 52 of the pump so as to store priming oil when the engine is stopped after some operation.

Figure 10:
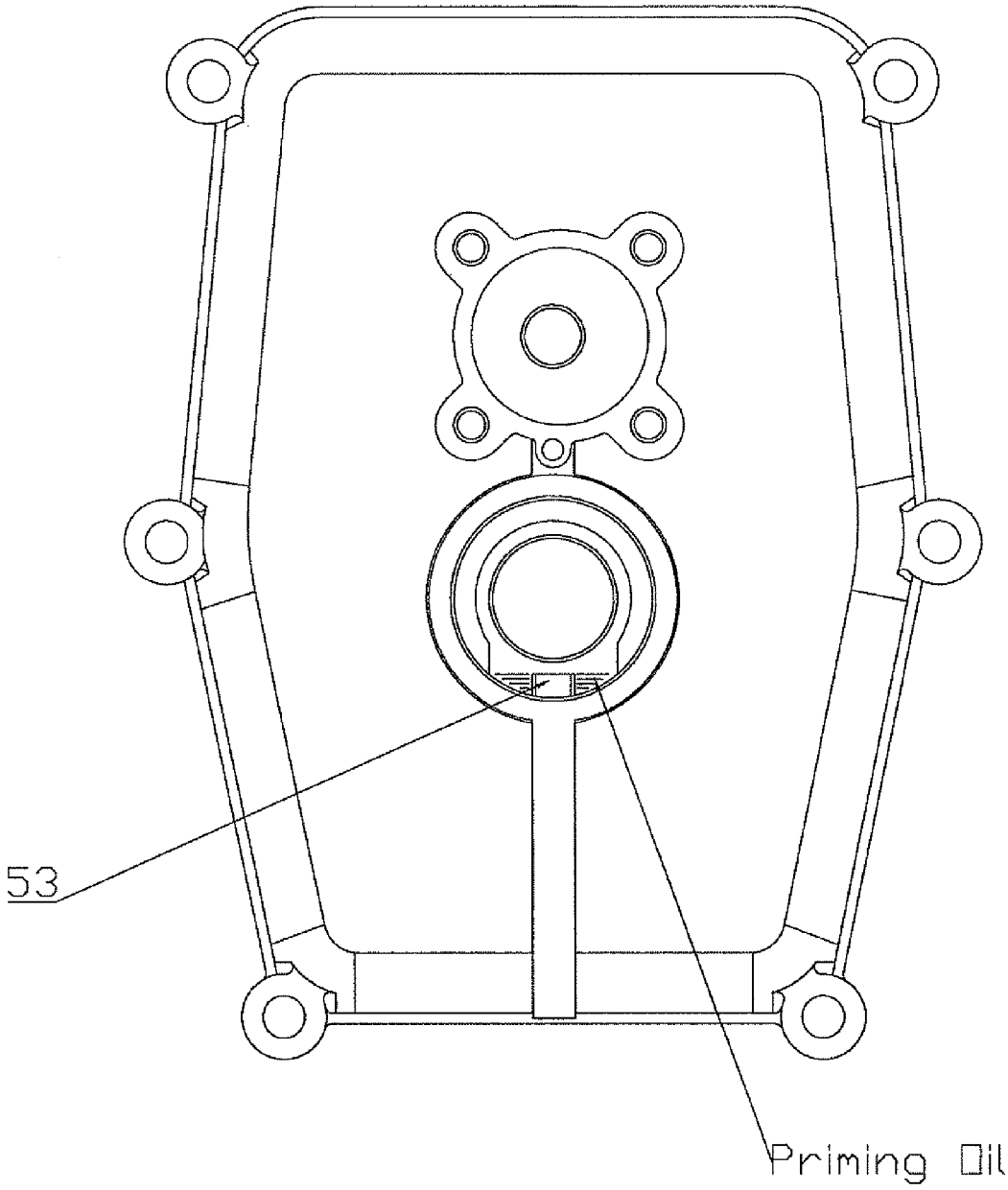
FIG. 10 is a sectional view of the side cover that shows keeping of priming oil for the inlet cavity between a bearing and an oil seal.

Further, as illustrated in FIG. 10, in the horizontal shaft engine of FIG. 2, oil entrance hole 53 in the space between bearing 27 and oil seal 47 is extended to the space so as to store priming oil when the engine is stopped after some operation.

Any other hole (not shown) at the wall of the camshaft 32 may lead oil to the valve actuating train. Accordingly, the engine parts inside the cylinder and crankcase are mist lubricated by the oil splashed by means of the rotation of and/or the centrifugal force generated by the rotating parts such as the web 24, 26 and the cam gear 31.

Figure 3:
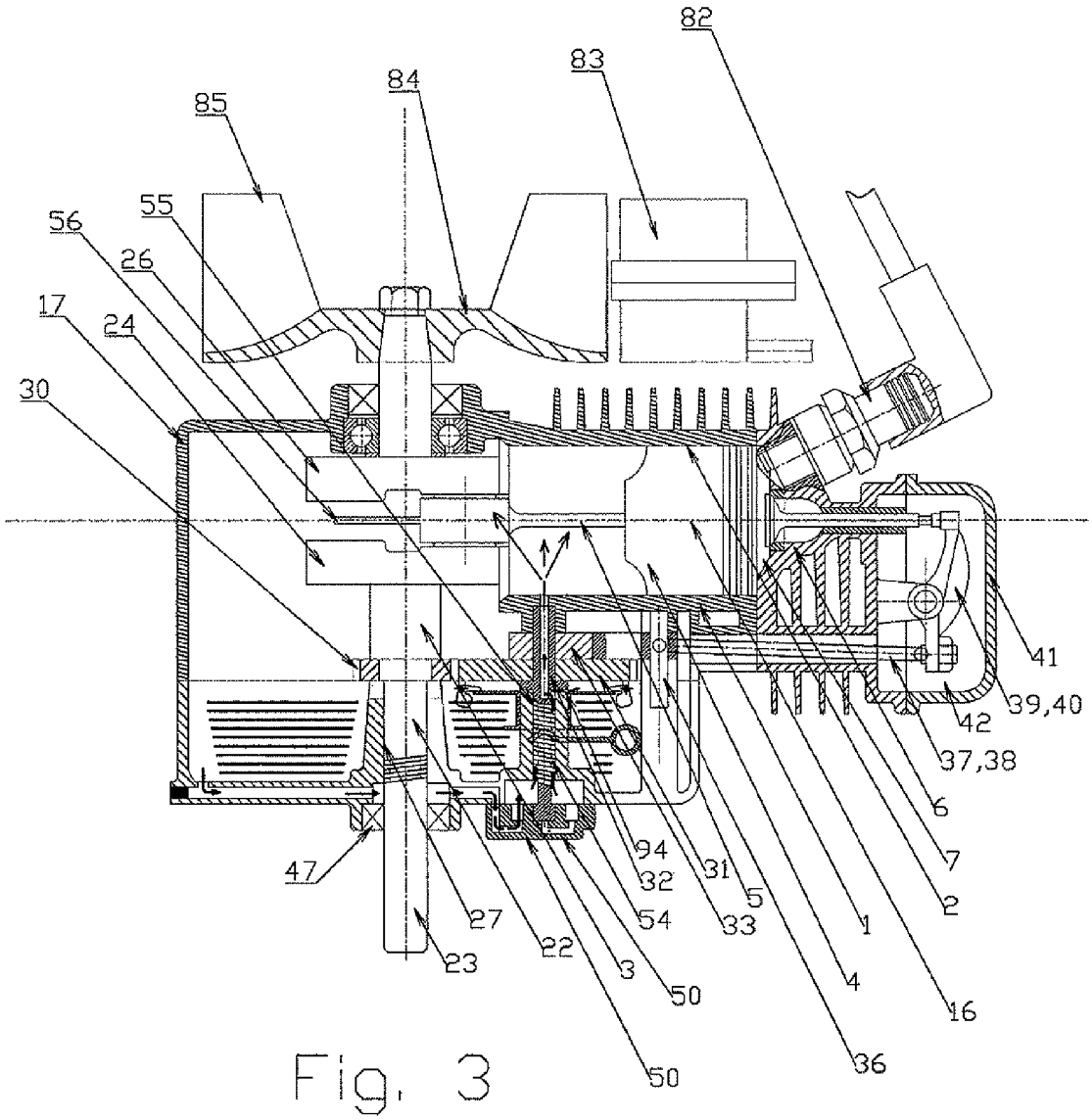
FIG. 3 is a cross-sectional side elevation view of another embodiment of a vertical shaft engine taken along the rotating axis of the crankshaft and axis of the cylinder bore.
Figure 4:
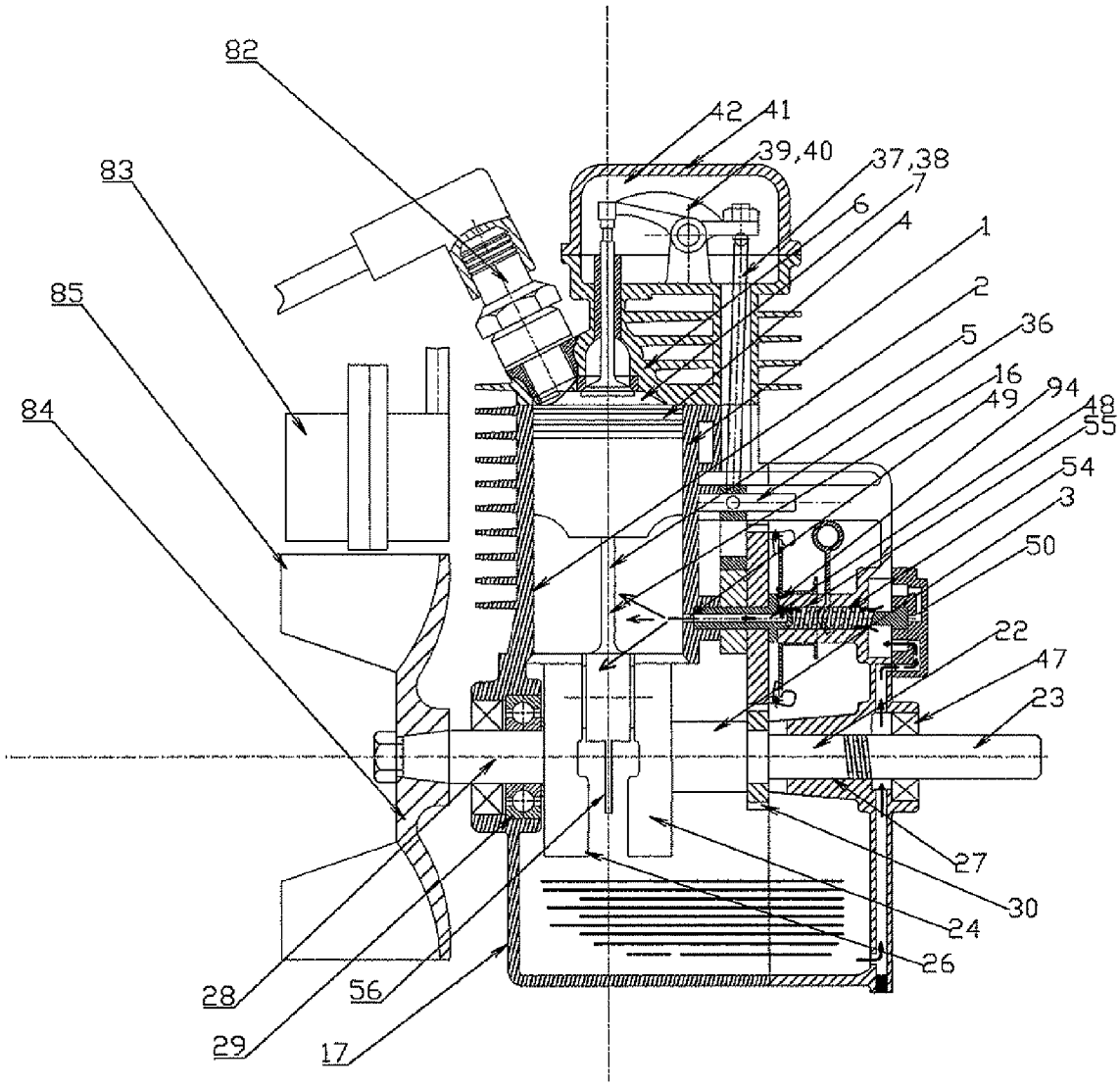
FIG. 4 is a cross-sectional side elevation view of another embodiment of a horizontal shaft engine taken along the rotating axis of the crankshaft and axis of the cylinder bore.

In other embodiments shown in FIG. 3 and FIG. 4, a screw pump 54 is formed between the bearing face 55 and an outside of the camshaft 32.

Construction of the vertical shaft engine of FIG. 3 is very close to the engine of FIG. 1 and that of the horizontal engine of FIG. 4 is very close to the engine of FIG. 2.

As an option, in the engine of FIG. 4 and/or FIG. 3, a dipper 56 may be provided. A dipper 56 agitates oil in an oil reservoir 21 when a power shaft is substantially horizontal and splashes oil when the power shaft is substantially vertical as an auxiliary means of screw pump 54.

Further, on the outer surface of the axial shaft 22 in the engine of FIGS. 1 to 4, a screw may be cut to inhale lubricating oil to the bearing surface 27.

In the engine of FIG. 1, 2, 3 or 4, a breather system is provided. The breather system is composed of a breather tube 57 and a check valve 58 as illustrated in FIG. 5 or FIG. 6.

As shown in FIG. 5, in the valve chamber 42, a breather tube 57 is opened through the valve cover 41 and is connected to an air cleaner case 59. The breathing oil mist sent through a tube is inhaled to the carburetor through a filter element 12. The check valve 58 is located at the position where it does not dip into oil in case of vertical or horizontal shaft engine.

Figure 6:
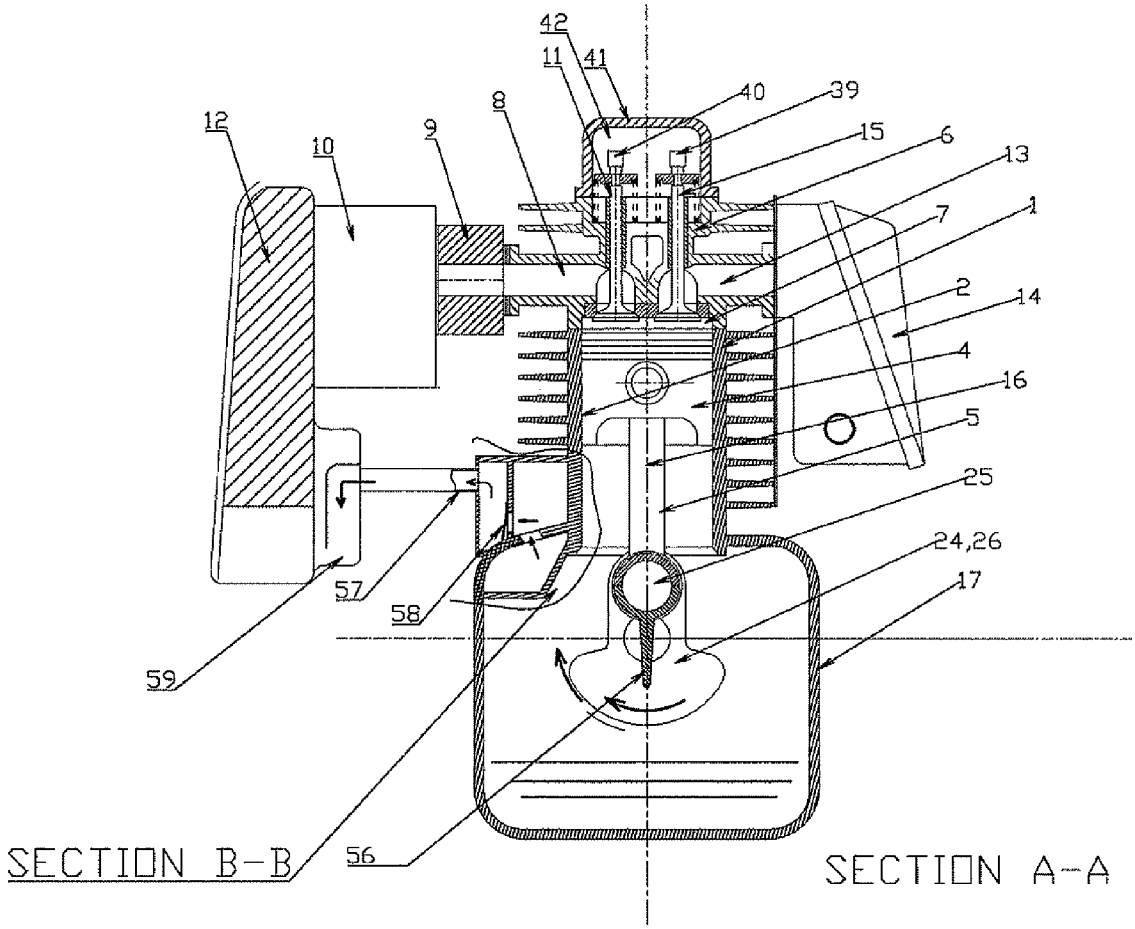
FIG. 6 is a cross-sectional side elevation view of the engine taken along line A-A and line B-B in FIG. 2 to show another embodiment of breather system.

FIG. 6 shows another embodiment of a breather system. In the wall of the cylinder block, a check valve 58 is provided and breathing mist sent through a tube is inhaled by the carburetor through a filter element 12. The check valve 58 is located at the position where it does not dip into oil in the case of either a vertical or a horizontal shaft engine.

Figure 8A:
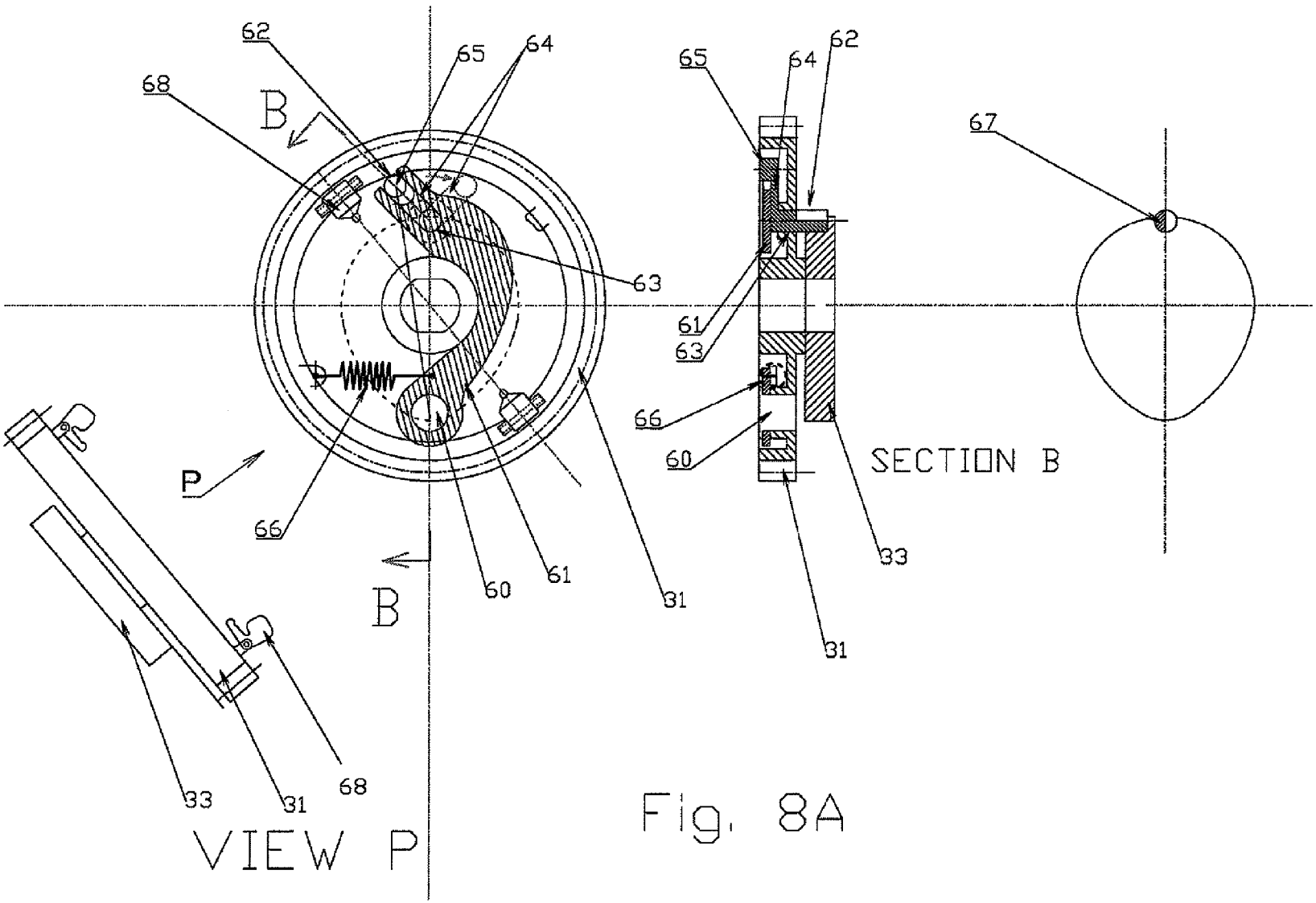
FIG. 8A is a sectional view of the de-compressor installed on the cam gear to illustrate the detailed construction.

In the engines above mentioned in FIGS. 1 to 4, a de-compressor may be provided. The de-compressor reduces compressed pressure in the cylinder when a starting pulley of the engine (not shown) is pulled. FIG. 8A shows a construction of the de-compressor.

A cylindrical pin 60 is formed integrally with or inserted into the cam gear 31. A weight 61 is pivotably attached to the pin 60. A cylindrical pin 63 of a bump cam lever 62 is pivotably attached to the cam gear 31. A lever 64 is provided to attach the pin 63. At the end of the lever 64, a pin 65 is provided, which pin is attached to a forked slit of the weight 61. One end of a tension spring 66 is attached to the weight 61 and the other end of the tension spring 66 is affixed to the cam gear 31 giving some pre-tensional load. At the end of the pin 63, a part of the pin is cut so that a remaining part of the pin forms a bump cam 67, which is inserted in the cam lobe as illustrated. The bump cam extrudes from the cam lobe when the engine is stopped or runs with low speed and the weight 61 is positioned as shown in FIG. 8A. When a starting action such as pulling rope by hand is done by an operator, the bump cam lifts the cam follower 34, 35 a little so that the exhaust and the inlet valves are lifted in the compression stroke of the engine and a required strength of farce when starting is reduced. After the engine is started and engine speed reaches more than a pre-determined value, a centrifugal force is added to the weight 61 and surpasses the spring force. The weight 61 turns clockwise. By the turning of the weight 61, the bump cam lever 64 turns clockwise as shown by dotted line in FIG. 8A. The turning of the weight 61 results in turning of the bump cam 67 so that the bump cam does not extend from the cam lobe. Then, the valves in the cylinder head are closed normally at a compression stroke and the engine works in a normal condition.

At the other side of the cam gear, a set of fly weights 68 for speed control of the engine is provided. The fly weights 68 are pivotably inserted by pin to the cam gear 31.

As shown in FIG. 1, the end of the fly weight 68 attaches to a slide piece 69. The slide piece 69 is supported to slide on a cylindrical surface 70 formed on the boss to support the camshaft 32. One end surface 71 of the slide piece 69 attaches to the fly weights 68. When the engine runs, the fly weight 68 is spread outwardly by centrifugal force and pushes the slide piece 69 to slide. On the other end of the slide piece 69, a contact face 72 is provided to contact the lever 73, which is affixed by a rotatable shaft 74.

Figure 8B:
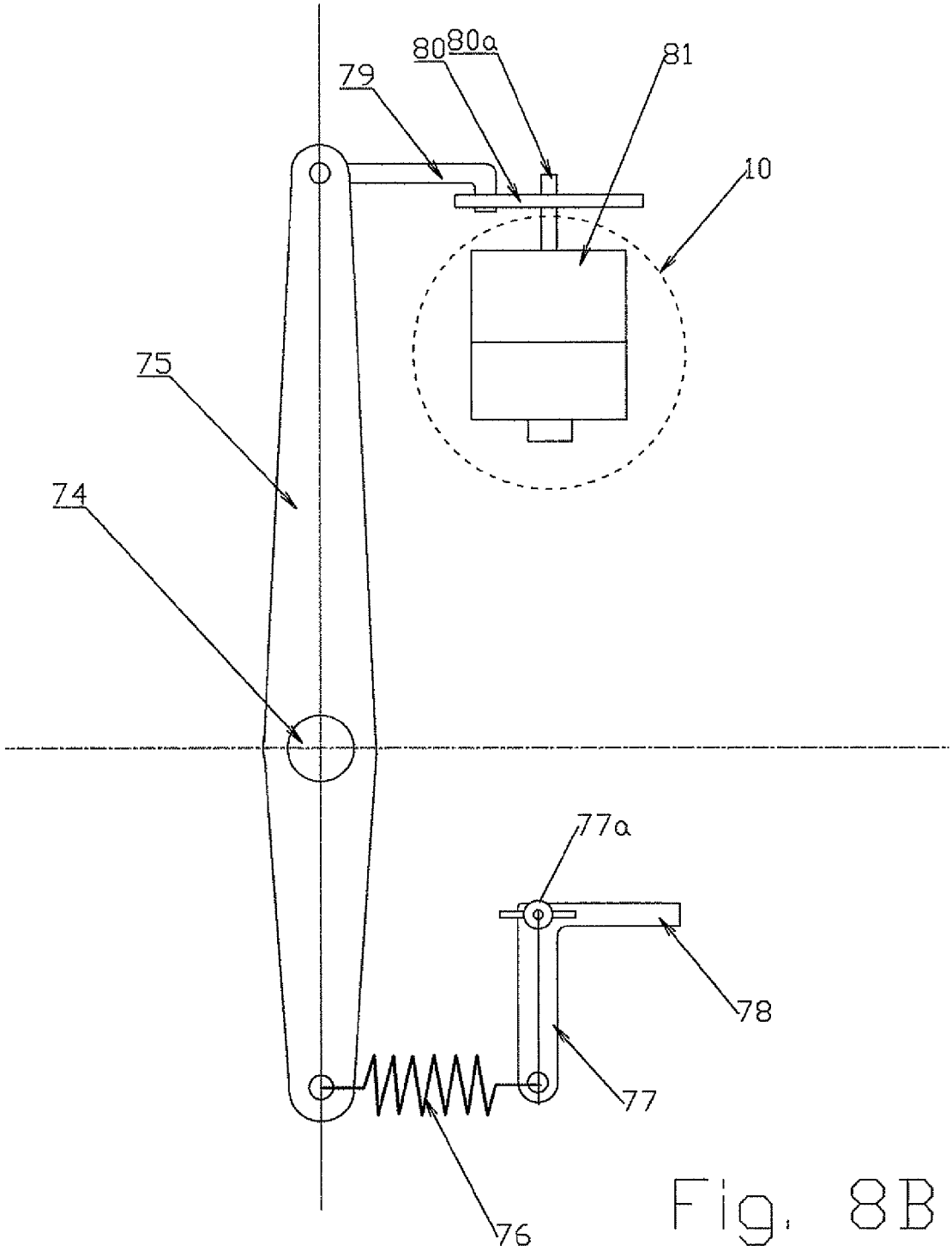
FIG. 8B is a schematic illustration of the speed adjusting mechanism.

The shaft 74 is pivotably provided on the wall of cylinder block 1 and is affixed to a governor lever 75 as shown in the FIG. 8B. At an end of the lever 75, a tension spring 76 is attached between an end of the governor lever 75 and an end of speed adjusting lever 77, which is pivotably supported on the cylinder block 1.

The governor lever 75 is connected to a rotatable throttle lever 80 by a connecting lever 79, which is pivotably attached to the governor lever 75 and a throttle lever 80.

The rotating axis 80*a* of the throttle lever 80 is supported by a throttle body 81 of the carburetor 10. In the throttle body 81, a throttle valve may be provided to control a power of the engine.

The speed adjusting lever 77 is provided with a handle 78. By turning the handle 78 at an adequate position and fixing the adjusting lever 77 by a butterfly nut 77*a*, spring force by the tension spring 76 is set.

Engine speed is controlled by a balance of centrifugal force given by the fly weight 68 and the tensional spring force by the spring 76.

Other parts not specifically referenced in the foregoing relate to conventional four-cycle engines. A spark plug 82 is installed in a spark plug hole formed in the cylinder head. A coil 83 is an ignition coil. A re-coil starter, not shown, having a re-winding rope is provided at a side of a flywheel 84, which inhales cooling air for the engine generated by rotation of blade 85 on the flywheel 84.

In order to achieve high power output and relatively low exhaust emissions, the four-cycle engine is provided with a very compact combustion chamber 7.

In vertical shaft engines as shown in FIG. 1 or FIG. 3, the engine can be started by pulling the winding rope without strong force helped by the de-compressor. Since oil entrance passage 46 is always dipped in the oil in the oil reservoir 20, lubricating oil is immediately inhaled to the oil pump 43 by rotation of the rotors 44, 45 through oil passage 46. The inhaled oil lubricates a crankshaft bearing at the space between the oil seal 47 and the bearing 27. A screw cut on the axial shaft 22 helps to inhale oil to the bearing surface 27 of the crankshaft. Then, oil is inhaled by the oil pump 43. The lubricating oil pressurized by the trochoid pump (FIG. 1) or the screw pump (FIG. 3) is sent into the cylinder or the valve train and lubricates moving parts of the engine.

In horizontal shaft engines such as those shown in FIG. 2 or FIG. 4, the engine can be started by pulling the winding rope without strong force helped by the de-compressor. Since oil entrance of the passage 46 is always dipped in the oil in the oil reservoir 21 and some of the priming oil is present in the pump and oil seal portion, lubricating oil is immediately inhaled by the oil pump 43 by rotation of the rotors 44, 45 through oil passage 46. The inhaled oil lubricates the crankshaft bearing at the space between oil seal 47 and bearing 27. A screw cut on the axial shaft 22 helps to inhale oil to the bearing surface 27 of the crankshaft. Then, oil is inhaled by the oil pump 43. Lubricating oil pressurized by the trochoid pump (FIG. 2) or the screw pump (FIG. 4) is sent into the cylinder or the valve train and lubricates moving parts of the engine.

Further, an auxiliary scraper 56 on the connecting rod 5 helps to agitate lubricating oil in the oil reservoir.

The breathing system works by the check valve 58 and pressure in the crankcase chamber 19 is kept normal during operation.

Operation speed control of the engine is accomplished by the following procedure. Tuning the adjusting handle 78 of speed control lever 77 and fixing it at an adequate position by the butterfly nut 77*a*, a spring 76 is pulled to produce a force to control the speed of the engine. If the load to the engine becomes lighter and the speed of engine rises to a level higher than the control speed, fly weight 68 opens widely and the sliding piece moves to close the throttle lever 80 via lever 73, 75, 79 to reduce engine power.

If load to the engine becomes heavier and the speed of engine decreases to a level lower than the control speed, the fly weight 68 opens narrowly and the sliding piece moves to open the throttle lever 80 via lever 73, 75, 79 to increase engine power. Thus, engine speed is controlled within some range of speed at any load.

Figure 11:
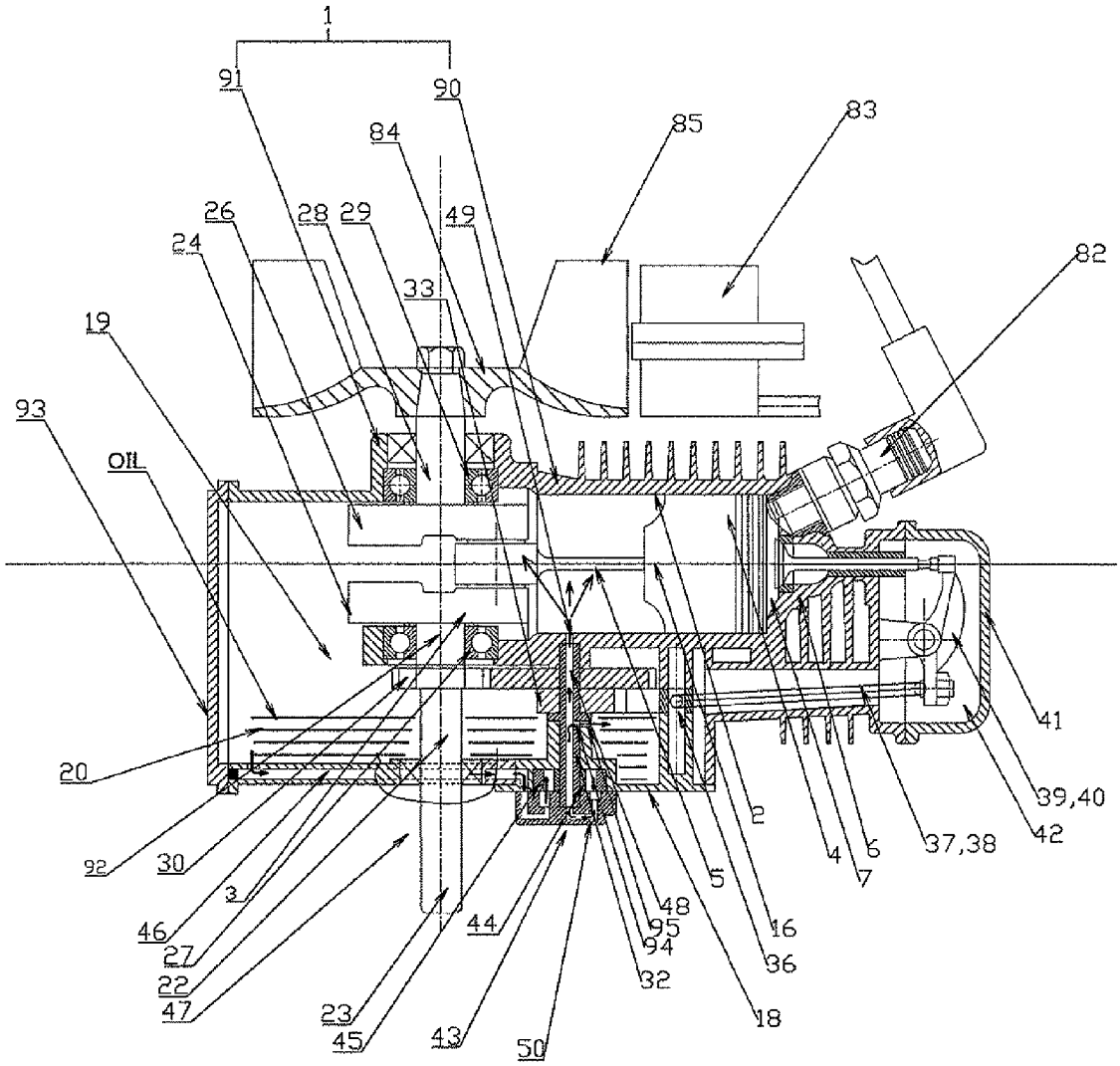
FIG. 11 is a cross-sectional side elevation view of the vertical shaft engine taken along the rotating axis of the crankshaft and axis of the cylinder bore according to another embodiment of the present invention.
Figure 12:
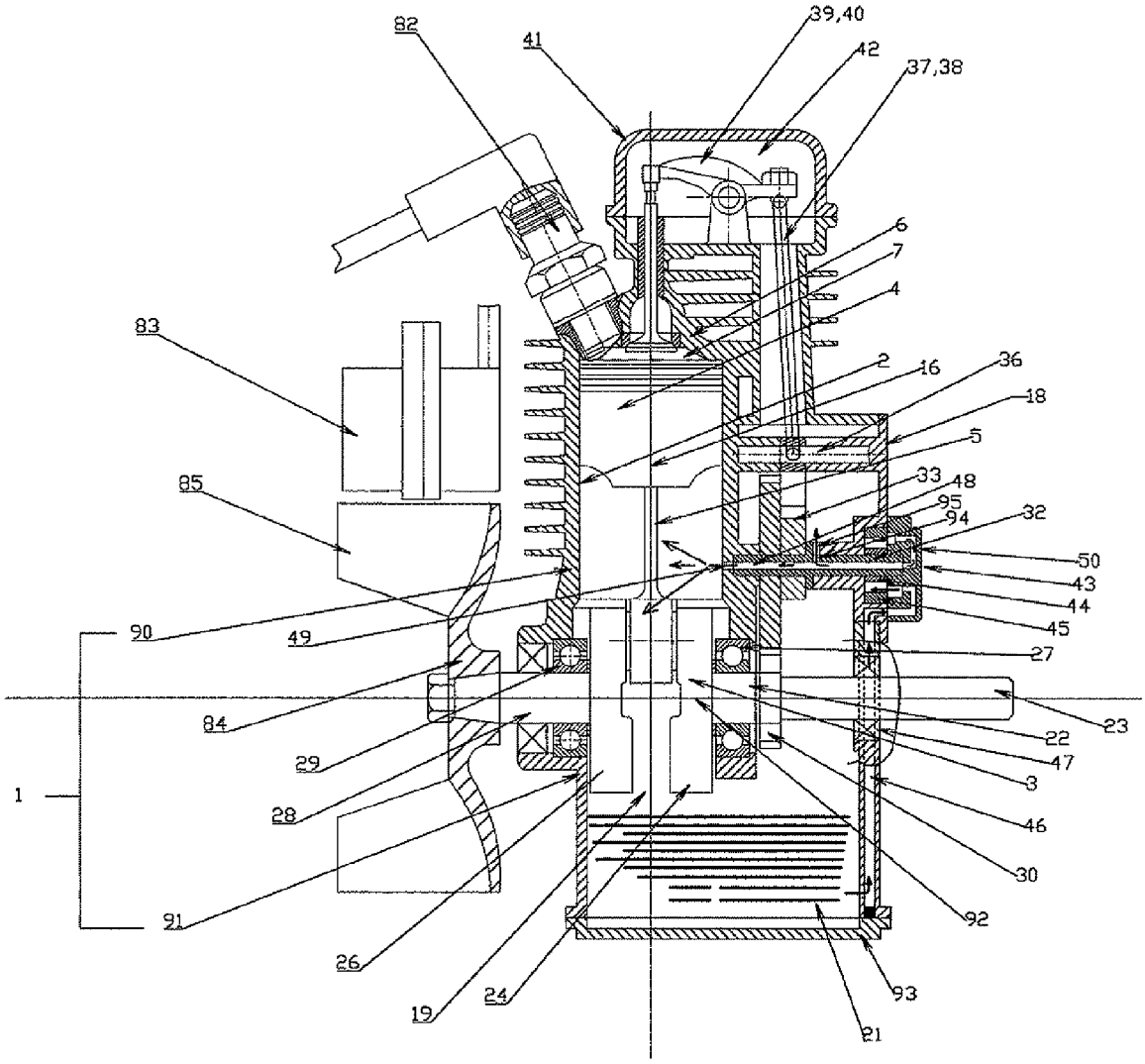
FIG. 12 is a cross-sectional side elevation view of the horizontal shaft engine taken along the rotating axis of the crankshaft and axis of the cylinder bore according to another embodiment of the present invention shown in FIG. 11.

FIGS. 11 and 12 show another embodiment of the present invention, wherein the cylinder 90 and a lower case 91 define a cylinder block 1 mating with each other in a plane which is perpendicular to the cylinder axis 16 and includes crankshaft axis 92. The cylinder head 6 is integrated with the cylinder 90.

The cylinder block 1 is mated with a side cover 18 to form a crankshaft chamber 19.

The lower case 91 and the crankshaft cover 93 also provide an enclosed oil reservoir 20 in a vertical shaft engine as illustrated in FIG. 11 and an oil reservoir 21 in a horizontal engine as illustrated in FIG. 12.

The axial shaft 22 of crankshaft 3 is coupled to a counterweight web 24 and pivotably attached to the cylinder block 1 by a bearing 27. Another axial shaft 28 of the crankshaft 3 is coupled to a counterweight web 26 and is pivotably attached to the cylinder block 1 by a bearing 29.

In the embodiment shown in FIGS. 11 and 12, the oil pushed out by the pump 43 is lead in parallel to a hole 49 at the cylinder wall and to a hole 94 formed in the outer wall of the cam shaft 32 through an inner through hole 48 of the camshaft 32 and into the cylinder bore 2 as illustrated in FIG. 1 and FIG. 2.

It is believed that small light-weight four cycle engines made in accordance with the present invention will be particularly suitable for use with utility power tools having a horizontal or vertical power shaft and is sufficiently manufactured to use common parts between vertical and horizontal shaft engines. In the prior art, various kinds of lubricating methods for utility power tools have been presented. However, most of them require complicated systems using more than one additional shaft to control flow of lubricating oil and speed of the engines. Further, construction of the engine is different between vertical and horizontal engines so that it is not economical when both vertical and horizontal engines are manufactured at the same period of time.

In the present invention, however, no additional shaft other than crank and camshaft parts is required to form the lubrication and speed control system and commonality of parts between vertical and horizontal shaft can be achieved to the greatest extent.

Further, the pump in the present invention is very low cost because it can be made easily by machining, injection mold process, and/or powder compaction molding. The rotors of the pump are placed in the side cover or a screw of the pump is cut on the camshaft so that manufacturing cost of the engine can be reduced.

Further, the working principle of the de-compressor and speed control system is conventional and reliable, but a specific feature of the present invention is that both systems are placed on a cam gear to be able to reduce manufacturing cost.

While the present invention is discussed in relation to the engine to be used with a small utility engine for stationary power tools, a person having ordinary skill in the art will readily realize that it can be also used with hand-held power tools or larger power equipment.

What is claimed is:

1. A single-cylinder, four-stroke cycle, spark ignition internal combustion engine for mounting on a power tool comprising:

a cylinder block having a cylinder;

a piston mounted for reciprocation in the cylinder;

a side cover attached to the cylinder block at a face parallel to an axis of said cylinder and perpendicular to a crankshaft axis defining a crankcase and an oil reservoir with said cylinder block;

a cylinder head defining an air-fuel combustion chamber;

an air-fuel mixture intake port and an exhaust gas port in said cylinder head;

a valve cover on said cylinder head defining a valve chamber;

an intake valve and an exhaust valve mounted in said intake and exhaust port, respectively, for reciprocation between port-open and port-closed positions;

a valve-actuating valve train, said valve train including at least one rocker arm and at least one valve train push rod assembly extending therefrom within said valve chamber and engaging said rocker arm;

a vertical crankshaft or a horizontal crankshaft pivotably mounted by a ball bearing or a plain bearing in the cylinder block and a ball bearing or a plain bearing in said side cover, said crankshaft including a crank portion and at least one counterweight web, a connecting rod having articulated connections at one end thereof to said piston and at an opposite end thereof to said crank portion, thereby forming a piston-connecting rod crankshaft assembly;

at least one cam rotatably mounted on a camshaft which is pivotably supported by said cylinder block and said side cover, said camshaft is connected to a cam gear driven by a crank gear on said crankshaft at one-half crankshaft speed, the opposite end of said push rod assembly being drivably connected to said cam whereby said push rod assembly is actuated with a reciprocating motion upon rotation of said at least one cam; and a trochoid oil pump connected drivably to said camshaft and placed at a wall of said side cover, wherein an inner and outer rotor of said pump are placed in said side cover and inhales lubrication oil from said oil reservoir through an inlet passage and splashes the oil into the cylinder and into the valve actuating train simultaneously to lubricate the engine parts inside the cylinder and the valve actuating train and the valve chamber, wherein an inlet hole of oil into said inlet passage is dipped in lubrication oil.

2. The engine set forth in claim 1, wherein said oil pump is a screw pump, and said screw pump is placed between said camshaft and said plain bearing.

3. The engine set forth in claim 1, wherein said inlet passage to the oil pump leads through a space between said bearing at said side cover and an oil seal to the wall of said side cover.

4. The engine set forth in claim 2, wherein the cylinder block, the side cover and main moving parts are substantially in common with each other between a vertical shaft engine and a horizontal shaft engine.

5. The engine set forth in claim 1, further comprising an oil scraper on said connecting rod.

6. The engine set forth in claim 1, further comprising a de-compressor and/or speed control governor on said cam gear, wherein slide piece of said governor is mounted on a outside cylindrical surface of a boss for said plain bearing of said side cover.

7. The engine set forth in claim 1, further providing priming oil area in an inlet cavity of said oil pump and space between the bearing and the oil seal.

8. The engine set forth in claim 1, wherein the cylinder block, the side cover and main moving parts are substantially in common with each other between a vertical shaft engine and a horizontal shaft engine.

9. A single-cylinder, four-stroke cycle, spark ignition internal combustion engine for mounting on a power tool comprising:

a cylinder;

a lower case mating with the cylinder at a plane perpendicular to the cylinder axis;

a cylinder block defined by the cylinder and the lower case;

a piston mounted for reciprocation in the cylinder;

a side cover attached to the cylinder block at a face parallel to an axis of said cylinder and perpendicular to a crankshaft axis defining a crankshaft chamber and an oil reservoir with said cylinder block;

a cylinder head attached with the cylinder defining an air-fuel combustion chamber;

an air-fuel mixture intake port and an exhaust gas port in said cylinder head;

a valve cover on said cylinder head defining a valve chamber;

an intake valve and an exhaust valve mounted in said intake and exhaust port, respectively, for reciprocation between port-open and port-closed positions;

a valve-actuating valve train, said valve train including at least one rocker arm and at least one valve train push rod assembly extending therefrom within said valve chamber and engaging said rocker arm;

a vertical crankshaft or a horizontal crankshaft pivotably mounted by ball bearing or plain bearing in the cylinder block, said crankshaft including a crank portion and at least one counterweight web, the axis of said crankshaft is included in the mating plane of the cylinder and the lower case.

a connecting rod having articulated connections at one end thereof to said piston and at an opposite end thereof to said crank portion, thereby forming a piston-connecting rod crankshaft assembly;

at least one cam rotatably mounted on a camshaft which is pivotably supported by said cylinder block and said side cover, said camshaft is connected to a cam gear driven by a crank gear on said crankshaft at one-half crankshaft speed, the opposite end of said push rod assembly being drivably connected to said cam whereby said push rod assembly is actuated with a reciprocating motion upon rotation of said at least one cam; and a trochoid oil pump connected drivably to said camshaft and placed at a wall of said side cover, wherein an inner and outer rotor of said pump are placed in said side cover and inhales lubrication oil from said oil reservoir through an inlet passage and splashes the oil into the cylinder and into the valve actuating train simultaneously to lubricate the engine parts inside the cylinder and the valve actuating train and the valve chamber, wherein an inlet hole of oil into said inlet passage is dipped in lubrication oil both in case of horizontal engine and vertical shaft engine.

10. The engine set forth in claim 9, wherein the cylinder block, the side cover and main moving parts are substantially in common with each other between a vertical shaft engine and a horizontal shaft engine.

* * * * *